US012061036B2

(12) United States Patent
Zhao et al.

(10) Patent No.: US 12,061,036 B2
(45) Date of Patent: Aug. 13, 2024

(54) UNIT LOAD DEVICE

(71) Applicant: Carrier Corporation, Palm Beach Gardens, FL (US)

(72) Inventors: Dan Zhao, Shanghai (CN); Zidu Ma, Ellington, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 178 days.

(21) Appl. No.: 17/082,808

(22) Filed: Oct. 28, 2020

(65) Prior Publication Data

US 2021/0131716 A1 May 6, 2021

(30) Foreign Application Priority Data

Nov. 5, 2019 (CN) ..... 201911070846.1

(51) Int. Cl.
*F25D 11/00* (2006.01)
*F25D 23/00* (2006.01)

(52) U.S. Cl.
CPC ..... *F25D 11/003* (2013.01); *F25D 23/00* (2013.01)

(58) Field of Classification Search
CPC .... F25D 11/003; F25D 11/006; F25D 19/003; F25D 2303/08; F25D 23/00; F25D 15/00; B65D 25/02; B65D 81/38
See application file for complete search history.

(56) References Cited

U.S. PATENT DOCUMENTS

| | | | | |
|---|---|---|---|---|
| 4,969,509 | A * | 11/1990 | Merensky | F25D 1/00 165/104.34 |
| 10,986,951 | B2 * | 4/2021 | Mitchell | B65G 1/1378 |
| 2007/0095092 | A1 * | 5/2007 | Wuerfel, III | B60P 3/20 62/239 |
| 2018/0252466 | A1 * | 9/2018 | Baker | B01L 7/52 |
| 2021/0222942 | A1 * | 7/2021 | Ros | F25D 11/003 |

FOREIGN PATENT DOCUMENTS

| | | | | |
|---|---|---|---|---|
| CN | 207963264 | U * | 10/2018 | |
| JP | 2014206355 | A * | 10/2014 | |
| WO | WO-2014080197 | A1 * | 5/2014 | F25D 11/003 |
| WO | WO-2018135034 | A1 * | 7/2018 | F25D 17/08 |

* cited by examiner

*Primary Examiner* — Ana M Vazquez
(74) *Attorney, Agent, or Firm* — CANTOR COLBURN LLP

(57) ABSTRACT

A unit load device, which includes: a box, which is configured to carry cargos and provide heat insulation for the cargos; an optional phase change energy storage material, which is disposed on an inner side face of the box and configured to maintain the temperature of the cargos in the box; and a temperature adjustment module, which is detachably connected to the box to provide cold and/or heat to the box. Different combinations of the box, the temperature adjustment module and the phase change material meet different needs in the cargo transportation process and ensure the transportation efficiency and quality of the cargos.

7 Claims, 2 Drawing Sheets

UNIT LOAD DEVICE

FOREIGN PRIORITY

This application claims priority to Chinese Patent Application No. 201911070846.1, filed Nov. 5, 2019, and all the benefits accruing therefrom under 35 U.S.C. § 119, the contents of which in its entirety are herein incorporated by reference.

TECHNICAL FIELD OF INVENTION

The present disclosure relates to a transportation device; more specifically, the present disclosure relates to a unit load device with a cooling function.

BACKGROUND OF THE INVENTION

Unit load device, also known as containerized transportation device, is containerizing equipment used to load cargos in air transportation. The cargos transported by the unit load device include medicines, chemical reagents and biological samples, etc., the temperatures of which need to be accurately controlled during the transportation to prevent the cargos from deteriorating and failing. Therefore, the unit load device that carries this kind of cargos needs to have an ability of accurate temperature adjustment. For example, taking medicines as an example, different medicines have different temperature requirements. For example, if some medicines need to be maintained at 5° C., the temperature in the box is required to be between 4° C. and 6° C. In a low-temperature external environment, such as the cold zone, heating function may be required to prevent the medicines from failing due to a very low temperature.

Other requirements for the unit load device include: low weight, large volume and small footprint.

SUMMARY OF THE INVENTION

An object of the present disclosure is to solve or at least alleviate problems existing in the related art.

According to an aspect, a unit load device is provided, which includes: a box, which is configured to carry cargos; and a temperature adjustment module, which is detachably connected to the box to provide cold and/or heat to the box; wherein the box includes a fluid inlet and a fluid outlet, and the temperature adjustment module includes a fluid output port and a fluid return port; when the temperature adjustment module is connected to the box, the fluid output port of the temperature adjustment module is connected with the fluid inlet of the box, and the fluid return port of the temperature adjustment module is connected with the fluid outlet of the box.

Optionally, in an embodiment of the unit load device, the temperature adjustment module is connected to the box by translation, so that pipe portions of the fluid output port and the fluid return port of the temperature adjustment module are inserted into the fluid inlet and the fluid outlet of the box.

Optionally, in an embodiment of the unit load device, the temperature adjustment module includes a temperature adjustment device and a battery for supplying energy to the temperature adjustment device.

Optionally, in an embodiment of the unit load device, valves are provided at the fluid inlet and the fluid outlet of the box, wherein the valves are opened when the temperature adjustment module is installed to the box, and the valves are closed when the temperature adjustment module is detached from the box.

Optionally, in an embodiment of the unit load device, the box includes a phase change material inside.

Optionally, in an embodiment of the unit load device, the phase change material is detachably installed in the box; in particular, the phase change material has a sheet shape and is detachably installed to at least one wall of the box.

Optionally, in an embodiment of the unit load device, the box is substantially of the shape of a cube, and the fluid inlet and the fluid outlet are located on a first side wall of the box.

Optionally, in an embodiment of the unit load device, the box includes an openable door, and the openable door is located on a second side wall opposite to the fluid inlet and the fluid outlet.

Optionally, in an embodiment of the unit load device, the box includes a fluid inflow channel and a fluid return channel, wherein the fluid inflow channel is in communication with the fluid inlet and has a portion at the first side wall of the box and a portion at a top side of the box, and the fluid return channel is in communication with the fluid outlet and has a portion at the first side wall of the box and a portion at a bottom side of the box; in particular, a top portion of the box may have a top inner partition to define a fluid inflow layer, and the top inner partition may include a plurality of ventilation holes; a bottom portion of the box may have a bottom inner partition to define a fluid return layer, and the bottom inner partition has a vent near the second side wall.

Optionally, in an embodiment of the unit load device, a detachably installed first phase change material sheet is provided on an inner wall of the second side wall of the box, and/or a detachably installed second phase change material sheet and a detachably installed third phase change material sheet are respectively provided at a third side wall and a fourth side wall between the first side wall and the second side wall.

BRIEF DESCRIPTION OF THE DRAWINGS

With reference to the accompanying drawings, the disclosure of the present disclosure will become easier to understand. It can be easily understood by those skilled in the art that these drawings are only for illustrative purpose, and are not intended to limit the scope of protection of the present disclosure. In addition, similar numbers in the drawings are used to denote similar components, in which.

DETAILED DESCRIPTION OF THE INVENTION

Figure 1:
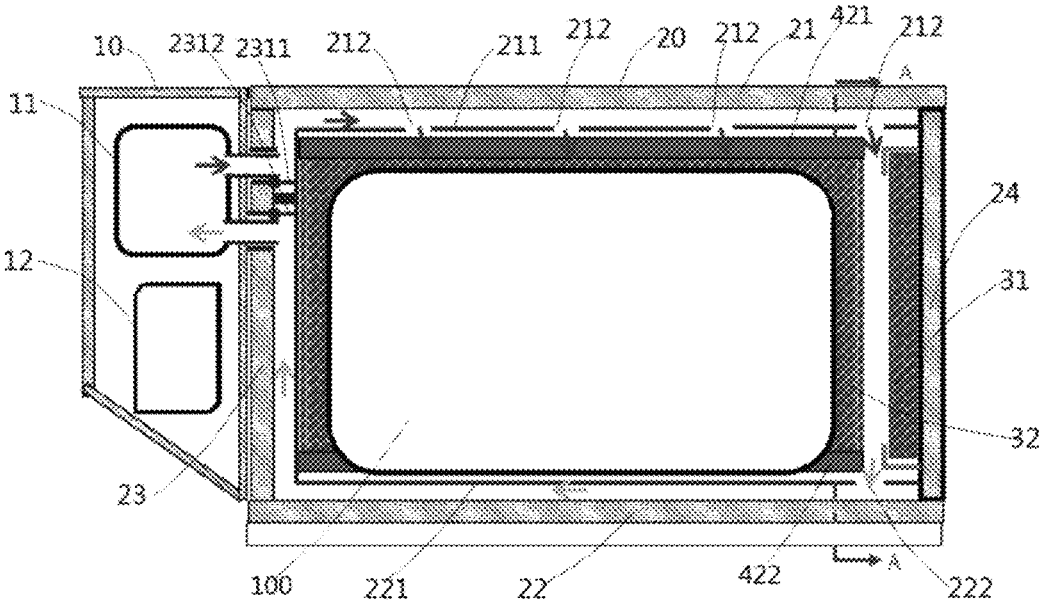
FIG. 1 shows a cross-sectional view of a unit load device according to an embodiment of the present disclosure when a temperature adjustment module is assembled with a box.

It can be easily understood that according to the technical solutions of the present disclosure, without changing the true spirit of the present disclosure, those skilled in the art can propose a variety of mutually replaceable structural modes and implementations. Therefore, the following specific embodiments and the accompanying drawings are merely exemplary illustrations of the technical solutions of the present disclosure, and should not be regarded as the entirety of the present disclosure or as definitions or limitations to the technical solutions of the present disclosure.

The orientational terms that have been mentioned or might be mentioned in this specification, such as "upper", "lower", "left", "right", "front", "rear", "front side", "back side", "top", "bottom", etc., are defined relative to the configurations shown in the drawings. They are relative concepts, so they may change accordingly according to their different locations and different states of use. Therefore, these or other orientational terms should not be interpreted as restrictive terms.

With reference to FIGS. 1 to 4, an assembled state and a disassembled state of the unit load device are shown respectively. The unit load device includes a box 20 and a temperature adjustment module 10. The box 20 is configured to carry cargos 100. The temperature adjustment module 10 is detachably connected to the box 20 to provide cold to the box 20 or further provide heat in some embodiments. As more clearly shown in FIG. 3, the box 20 includes a fluid inlet 231 and a fluid outlet 232. The temperature adjustment module 10 includes a fluid output port 111 and a fluid return port 112. When the temperature adjustment module 10 is connected to the box 20, the fluid output port 111 of the temperature adjustment module 10 is connected with the fluid inlet 231 of the box 20, and the fluid return port 112 of the temperature adjustment module 10 is connected with the fluid outlet 232 of the box 20. In some embodiments, the temperature adjustment module 10 is disassembled from or assembled to the box 20 by translation in the direction of the arrow in FIG. 3. The unit load device according to the embodiment of the present disclosure includes a detachable temperature adjustment module 10, so that the temperature adjustment module 10 can be detached before the airplane takes off, and only the box 20 is carried during the transportation, thereby reducing the weight actually carried by the airplane. On the other hand, for some types of cargos 100, for the purpose of confidentiality, the user expects to ensure the seal of the box 20 during transportation. In this situation, a plurality of temperature adjustment modules 10 can be used to cool the box 20 without having to open the box 20. In some embodiments, the temperature adjustment module 10 may include a temperature adjustment device 11 (which may have cooling and/or heating functions, and the cooling situation will be used as examples below) and a battery 12, wherein the battery 12 provides power to the temperature adjustment device 11.

In some embodiments, in order to keep the temperature of the box 20 after the temperature adjustment module 10 is disassembled, valves 2311, 2321 may be provided at the fluid inlet 231 and the fluid outlet 232 of the box. When the temperature adjustment module 10 is installed to the box 20, the valves 2311, 2321 are open, and when the temperature adjustment module 10 is detached from the box 20, the valves 2311, 2321 are closed. As shown in the drawings, the valves 2311, 2312 are automatically driven by elastic devices, so as to switch from the open position shown in FIG. 1 to the closed position shown in FIG. 3. For example, the valves 2311, 2321 may be elastic valve plates, or may be installed through elastic members such as torsional springs. Pipe portions of the fluid output port 111 and the fluid return port 112 of the temperature adjustment module 10, when inserted into the fluid inlet 231 and the fluid outlet 232 of the box 20, push the valves 2311, 2321 to open, and when the pipe portions of the fluid output port 111 and the fluid return port 112 of the temperature adjustment module 10 are extracted, the valves 2311, 2321 return to the closed position shown in FIG. 3 under the action of the elastic members. In addition, in some embodiments, inserts or sealing members may be provided to further seal the fluid inlet 231 and the fluid outlet 232, thereby providing heat insulation. In addition, in an alternative embodiment, the valves 2311, 2321 at the fluid inlet 231 and the fluid outlet 232 of the box 20 may be valves automatically opened and closed driven by an electric device, such as solenoid valves. They are opened when it is detected that the temperature adjustment module 10 is connected to the box 20, and are closed when it is detected that the temperature adjustment module 10 is detached from the box 20.

In some embodiments, the box 20 includes phase change materials 31, 32 and 33. The phase change materials 31, 32 and 33 for example store the cold provided by the temperature adjustment module 10 or provided by other temperature adjustment modules, and provide the cold to the unit load device when the temperature adjustment module 10 is detached or the electricity is exhausted. Due to the presence of the phase change materials to provide additional cold, the battery of the temperature adjustment module 10 may be designed to be relatively small, thereby increasing the volume of the box 20 without losing the operating time or shortening the battery charging time. In addition, the battery and the phase change materials may be charged separately, thereby shortening the charging time. In some embodiments, the phase change materials may be encapsulated in foamed copper plates, thereby enhancing internal heat transfer and making the temperature in the box 20 more uniform. In some other embodiments, the phase change materials may have other shapes or may be arranged in the box 20 in other suitable forms. In some embodiments, the phase change materials are detachably installed in the box 20. In some embodiments, the phase change materials have a sheet shape and are detachably installed on at least one wall of the box 20. The cold provided by the temperature adjustment module 10 can be stored by providing the phase change materials, thereby maintaining the temperature of the box 20 when the box 20 is transported alone. The detachable phase change materials provide flexible applications. For example, when the temperature adjustment module 10 is transported with the box 20, the phase change materials can be detached to reduce the overall weight of the unit load device.

Figure 2:
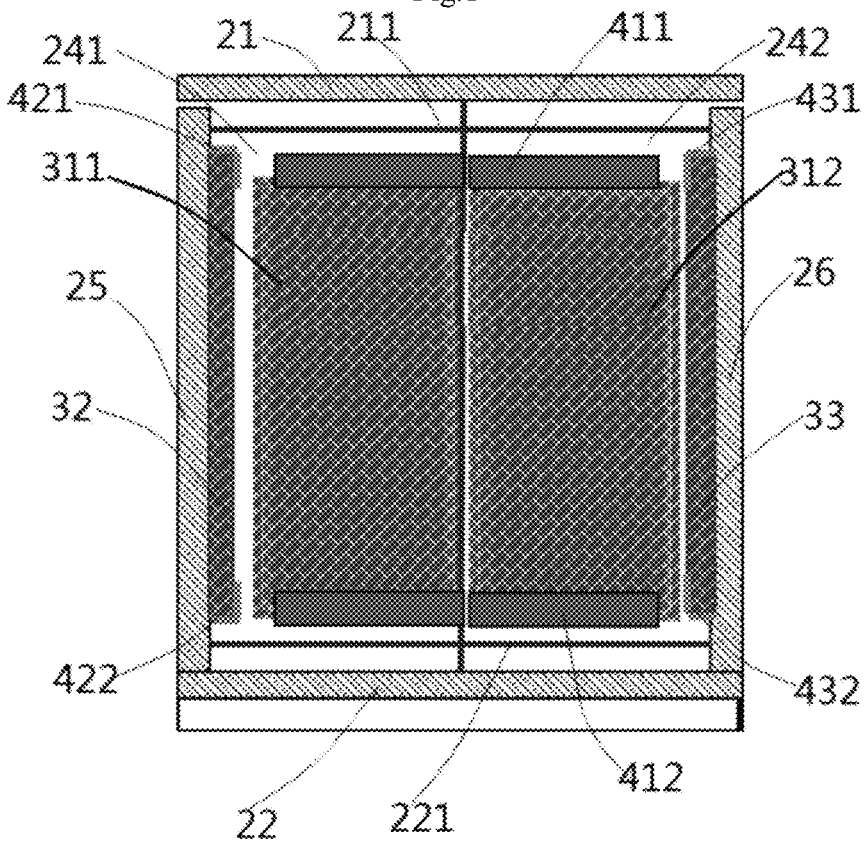
FIG. 2 is a cross-sectional view of the A-A section of FIG. 1.

In some embodiments, the box 20 is substantially of the shape of a cube, including a first side wall 23 and a second side wall 24 opposite to each other, a top wall 21, a bottom wall 22, and a third side wall 25 and a fourth side wall 26 between the first side wall 23 and the second side wall 24. In some embodiments, the fluid inlet 231 and the fluid outlet 232 are located on the first side wall 23 of the box 20. In some embodiments, the fluid inlet 231 and the fluid outlet 232 are located close to each other. In some embodiments, the box 20 includes an openable door located on the second side wall 24 opposite to the fluid inlet and the fluid outlet. In some embodiments, as shown in FIG. 2, the openable door is of a dual door arrangement, including a first half door 241 and a second half door 242. In some embodiments, the openable door may be of a single door arrangement. In some embodiments, the inner wall of the second side wall 24 of the box 20 is provided with a first phase change material sheet 31 that is detachably installed. In some embodiments, back sides of the openable doors 241, 242 are provided with the first phase change material sheet. When the openable doors 241, 242 are of the dual door arrangement, the first phase change material sheet is also formed as two halves 311, 312, which are insertedly installed to the back sides of the openable doors 241, 242 respectively for example through a pair of fixing devices 411, 412 having a L-shaped cross-section and arranged in upper and lower positions, and the phase change material sheet may be detached by being pulled out. In some embodiments, the third side wall 25 and the fourth side wall 26 are respectively provided with a second phase change material sheet 32 and a third phase change material sheet 33 that are detachably installed. With the phase change materials arranged on the back sides of the doors and the two side walls, the temperature distribution in the box 20 can be made more uniform. In some embodiments, each of the second phase change material sheet 32 and the third phase change material sheet 33 is insertedly installed to inner sides of the second side wall 25 and the third side wall 26 respectively for example through a pair of fixing devices 421, 422, 431 and 432 having a L-shaped cross-section and arranged in upper and lower positions, and the phase change material sheet is detached by being pulled out from the second side wall 24 when the door is opened.

Figure 3:
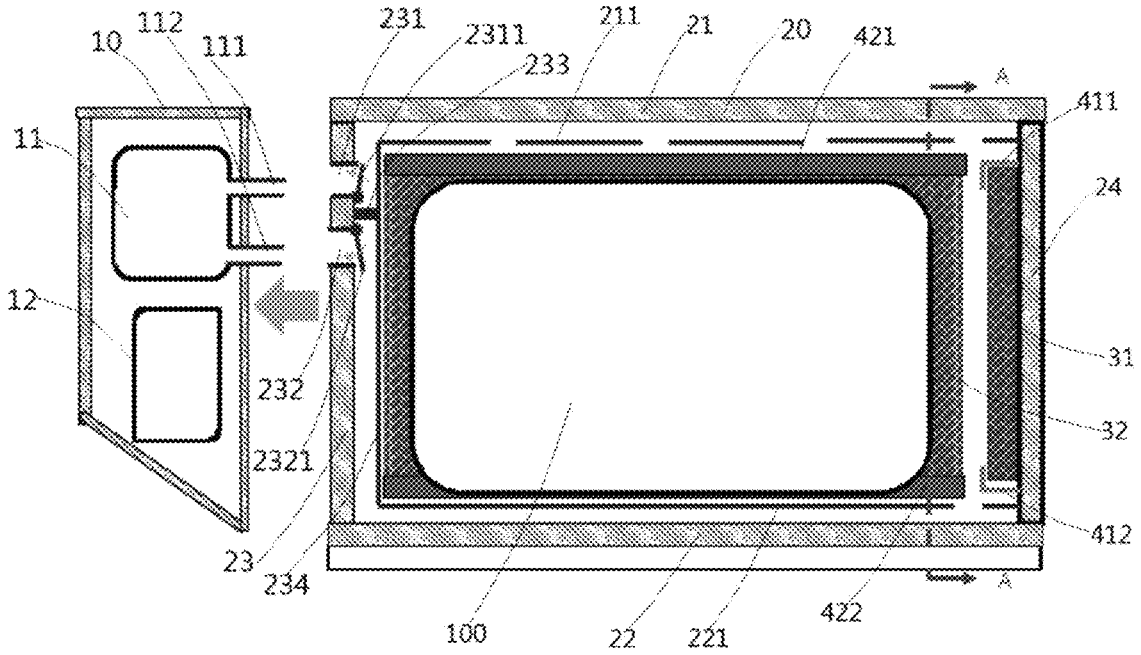
FIG. 3 shows a cross-sectional view of the unit load device according to the embodiment of the present disclosure when the temperature adjustment module is separated from the box.

In some embodiments, the box 20 includes a fluid inflow channel and a fluid return channel. The fluid inflow channel is in communication with the fluid inlet 231 and has a portion at the first side wall 23 of the box 20 and a portion at the top side 21 of the box 20, and the fluid return channel is in communication with the fluid outlet 232 and has a portion at the first side wall 23 of the box 20 and a portion at the bottom side 22 of the box 20. As can be seen in FIG. 3, a partition 234 is disposed near the first side wall 23 to define portions of the fluid inflow channel and the fluid return channel, and a separation plate 233 separates the fluid inflow channel from the fluid return channel. As shown in FIG. 3, when opened, the valves 2311, 2321 are respectively rotated to approach the separation plate 233. In some embodiments, a top inner partition 211 may be provided on the top of the box 20 to define a fluid inflow layer. In some embodiments, the top inner partition 211 may include a plurality of ventilation holes 212 to communicate the incoming fluid to the cargos 100. In some embodiments, as shown in FIGS. 1 and 3, a plurality of ventilation holes 212 are distributed at different positions between the first side wall 23 and the second side wall 24. In some embodiments, a bottom portion of the box 20 may have a bottom inner partition 221 to define a fluid return layer. In some embodiments, the bottom inner partition 221 has a vent 222 near the second side wall 24 to return fluid from the cavity of the cargos 100.

Figure 4:
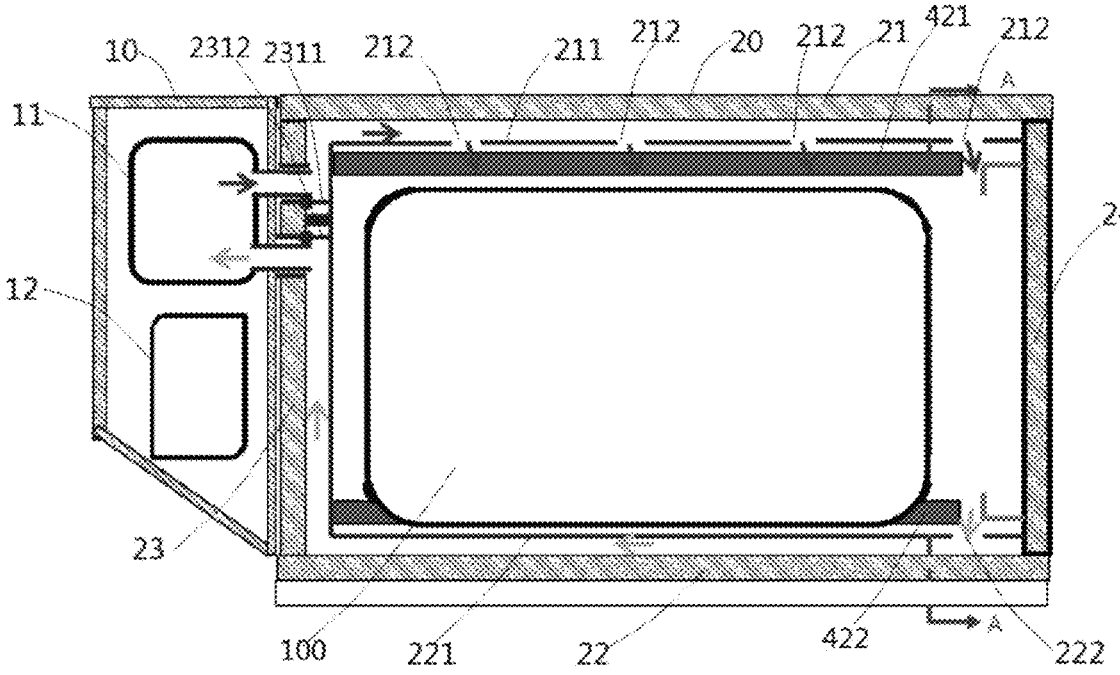
FIG. 4 shows a cross-sectional view of the unit load device of FIG. 1 after the phase change material sheets are detached.

As shown in FIG. 4, after the phase change material sheets 31, 32 and 33 are detached, the box 20 can provide a larger space to accommodate the cargos, and the overall weight of the box 20 can be reduced.

The unit load device according to various embodiments of the present disclosure provides various flexible applications. For example, for short-distance transportation requiring precise temperature control, the temperature adjustment module 10 may be inserted and the phase change material sheets may be detached, thereby providing a large space and a low weight. For short-distance transportation not requiring precise temperature control, the temperature adjustment module 10 may be removed and only the phase change material sheets may be used to maintain the temperature. For long-distance transportation requiring precise temperature control, this can be achieved through a combined application of the temperature adjustment module 10 and the phase change material sheets. For example, the temperature adjustment module includes a battery and can be assembled/disassembled in an inserted manner. The temperature adjustment module is detached before the airplane transportation, and the temperature adjustment module is reinstalled after the airplane transportation. This reduces the weight carried by the airplane and improves the efficiency of the airplane transportation. During the flight, the phase change material plates may provide continuous cooling capacity, so that the temperature stability in the unit load device can be ensured during the airplane transportation. In some embodiments, the temperature adjustment module can be installed at any time to provide cooling to the box. In some embodiments, some or all of the phase change material plates may be detached and replaced, and the phase change material plates may be charged with cold (store cold) by the temperature adjustment module or detached from the box to be charged with cold by other temperature adjustment modules. Based on various embodiments, the unit load device according to various embodiments of the present disclosure can provide flexible and efficient services according to different transportation purposes. For example, for short-distance flights or transportation, the temperature adjustment module can be detached and only the phase change material sheets provide cooling; whereas for long-distance flights or transportation, the temperature adjustment module can be retained. For example, a long-distance (theoretically unlimitedly long) cooling of the box is realized by successively cooling the box by a plurality of temperature adjustment modules. For example, a double guarantee of the temperature adjustment module and the phase change material sheets can be provided to increase reliability and avoid damage to the cargos when the temperature adjustment module fails. Other advantages include easy maintenance. For example, if the box is damaged, only the box needs to be replaced, or if the temperature adjustment module is damaged, only the temperature adjustment module needs to be replaced and the damaged temperature adjustment module will be repaired.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. Therefore, it should be understood that these modifications or changes should be included within the scope of protection of the present disclosure.

What is claimed is:

1. A unit load device, comprising:

a box, which is configured to carry cargos;

a temperature adjustment module having a cooling and/or heating module, which is detachably connected to the box to provide at least one of cold and heat to the box;

wherein the box comprises a fluid inlet and a fluid outlet, and the temperature adjustment module comprises a fluid output port and a fluid return port;

wherein, when the temperature adjustment module is connected to the box, the fluid output port of the temperature adjustment module is connected with the fluid inlet of the box, and the fluid return port of the temperature adjustment module is connected with the fluid outlet of the box; and valves provided at the fluid inlet and the fluid outlet; and an automated element associated with the fluid inlet and the fluid outlet;

wherein the automated element, responsive to a determination that the temperature adjustment module is installed to the box, opens the valves;

wherein the automated element, responsive to a determination that the temperature adjustment module is detached from the box, closes the valves; and the automated element comprises pipe portions;

wherein the pipe portions, when inserted into the fluid inlet and the fluid outlet, cause the valves to open; and wherein the pipe portions, when extracted from the fluid inlet and the fluid outlet, enable the valves to close under action of automated closure elements of the valves.

2. The unit load device according to claim 1, wherein:

the pipe portions, when inserted into the fluid inlet and the fluid outlet, cause the valves to open; and the pipe portions, when extracted from the fluid inlet and the fluid outlet, enable the valves to close under action of automated closure elements of the valves.

3. The unit load device according to claim 1, wherein:

the temperature adjustment module comprises a temperature adjustment device; and the temperature adjustment module comprises a battery for supplying energy to the temperature adjustment device.

4. The unit load device according to claim 1, wherein the box comprises a phase change material inside.

5. The unit load device according to claim 4, wherein the phase change material is detachably installed in the box; in particular, the phase change material has a sheet shape and is detachably installed to at least one wall of the box.

6. A unit load device, comprising:

a box, which is configured to carry cargos;

a temperature adjustment module having a cooling and/or heating module, which is detachably connected to the box to provide at least one of cold and heat to the box;

wherein the box comprises a fluid inlet and a fluid outlet, and the temperature adjustment module comprises a fluid output port and a fluid return port;

wherein, when the temperature adjustment module is connected to the box, the fluid output port of the temperature adjustment module is connected with the fluid inlet of the box, and the fluid return port of the temperature adjustment module is connected with the fluid outlet of the box;

valves provided at the fluid inlet and the fluid outlet; and an automated element associated with the fluid inlet and the fluid outlet;

wherein the automated element, responsive to a determination that the temperature adjustment module is installed to the box, opens the valves;

wherein the automated element, responsive to a determination that the temperature adjustment module is detached from the box, closes the valves;

wherein the box is substantially of the shape of a cube, and the fluid inlet and the fluid outlet are located on a first side wall of the box;

wherein the box comprises an openable door, and the openable door is located on a second side wall opposite to the fluid inlet and the fluid outlet; and wherein the box comprises a fluid inflow channel and a fluid return channel; the fluid inflow channel is in communication with the fluid inlet and has a portion at the first side wall of the box and a portion at a top side of the box, and the fluid return channel is in communication with the fluid outlet and has a portion at the first side wall of the box and a portion at a bottom side of the box; in particular, a top portion of the box comprises a top inner partition to define a fluid inflow layer, and the top inner partition comprises a plurality of ventilation holes; a bottom portion of the box comprises a bottom inner partition to define a fluid return layer, and the bottom inner partition has a vent near the second side wall.

7. The unit load device according to claim 6, wherein a detachably installed first phase change material sheet is provided on an inner wall of the second side wall of the box, and/or a detachably installed second phase change material sheet and a detachably installed third phase change material sheet are respectively provided at a third side wall and a fourth side wall between the first side wall and the second side wall.

* * * * *